US008051781B1

(12) United States Patent
Vind et al.

(10) Patent No.: US 8,051,781 B1
(45) Date of Patent: Nov. 8, 2011

(54) SHELF FOR OVERLYING A SHOWER BARRIER

(76) Inventors: Krista K. Vind, Niceville, FL (US); Clayton J. Vind, Niceville, FL (US)

( * ) Notice: Subject to any disclaimer, the term of this patent is extended or adjusted under 35 U.S.C. 154(b) by 892 days.

(21) Appl. No.: 11/703,889

(22) Filed: Feb. 9, 2007

(51) Int. Cl.
*A47H 1/08* (2006.01)

(52) U.S. Cl. ..... 108/42; 211/105.1; 211/175; 211/123; 211/105.6; 108/102; 108/137

(58) Field of Classification Search ..... 211/153, 211/175, 88.02, 105.1, 87.01, 90.02, 105.3–105.6, 211/123; 312/205, 332.1; 108/137, 143, 108/29, 87, 102, 54.1, 42, 147.19, 44; 4/558, 4/559, 608, 605; 248/236, 214, 241, 250
See application file for complete search history.

(56) References Cited

U.S. PATENT DOCUMENTS

| | | | | | |
|---|---|---|---|---|---|
| 1,830,347 | A | * | 11/1931 | Camden et al. | 108/137 |
| 1,836,126 | A | * | 12/1931 | Luce | 108/42 |
| 1,852,357 | A | * | 4/1932 | Merhar | 108/149 |
| 1,872,740 | A | * | 8/1932 | James | 108/149 |
| 2,780,365 | A | * | 2/1957 | Trainor | 211/85.3 |
| 3,995,330 | A | | 12/1976 | Meyers | |
| 4,192,426 | A | * | 3/1980 | Gauthier | 211/105.4 |
| 4,194,313 | A | * | 3/1980 | Downing | 40/610 |
| 4,870,907 | A | | 10/1989 | McKee | |
| D315,653 | S | | 3/1991 | Truffa | |
| 5,154,218 | A | | 10/1992 | Subecz | |
| 5,181,621 | A | | 1/1993 | Plaehn | |
| 5,331,904 | A | * | 7/1994 | DiSimone et al. | 108/44 |
| 5,433,152 | A | | 7/1995 | Henry | |
| 5,443,019 | A | * | 8/1995 | Sheldrick | 108/44 |
| 5,794,281 | A | | 8/1998 | Shearon | |
| 5,833,337 | A | * | 11/1998 | Kofstad | 312/334.5 |
| D424,415 | S | | 5/2000 | Buttler | |
| D466,399 | S | | 12/2002 | Jessee et al. | |
| 6,520,092 | B2 | * | 2/2003 | Marshall et al. | 108/44 |
| 6,543,629 | B1 | | 4/2003 | Samelson | |
| 6,588,030 | B1 | | 7/2003 | Wulff | |
| 6,655,538 | B2 | | 12/2003 | Saulnier-Matteini | |
| 6,688,238 | B1 | | 2/2004 | Alexiou | |
| 6,698,602 | B2 | | 3/2004 | Taylor | |
| 2006/0130715 | A1 | * | 6/2006 | Yoo et al. | 108/116 |

* cited by examiner

*Primary Examiner* — Darnell M Jayne
*Assistant Examiner* — Andres Gallego
(74) *Attorney, Agent, or Firm* — Peter Loffler

(57) ABSTRACT

A shelf for overlying a shower barrier uses a pair of shelves that are connected by a connector shelf allowing the device to telescope. Each of the pair of shelves abut a side wall and overlie a curtain rod or the top of a shower door. Each shelf has a flat upper surface and a decorative downwardly depending front surface for enhancing the aesthetics of the shower enclosure and concealing the rod or top of the door. Various devices can be used to hold the shelves against the walls including telescoping rods attached to the connector shelf and the other two shelves with a set screw holding the rods in place. A compression spring can also push on the outer shelves; or screws can pass through either screw bosses on the two other shelves and into the respective walls or a bracket can, be attached to the outer shelves and the walls.

6 Claims, 8 Drawing Sheets

SHELF FOR OVERLYING A SHOWER BARRIER

This application claims the benefit of the Document Disclosure bearing Ser. No. 604,495, issued on Aug. 11, 2006, which Document Disclosure is incorporated herein by reference.

BACKGROUND OF THE INVENTION

1. Field of the Invention

The present invention relates to a shelf that allows storage of various items thereon and aesthetically conceals a shower curtain rod from external view.

2. Background of the Prior Art

Most homes have one shower therein, with some having multiple units. One of the most common ways to close off a shower enclosure during use, in order to keep the shower water from splashing all over the bathroom, is through the use of a shower curtain. This simple device uses a rod that is positioned and secured between the end walls of the shower enclosure and the rod has a plurality of hooks that slide therealong and which hooks have a curtain hanging therefrom. When not in use, the shower curtain is slid to an open position, oftentimes held in such position by an appropriate tie or other similar device. When the shower is being used, the lower end of the curtain is positioned within the confines of the tub basin and the curtain is slid closed thereby directing the shower water into the tub. This simple utilitarian device is very effective in keeping most, if not all of the water, wherein belongs, within the tub.

The problem with shower curtains lies in their utilitarian existence. The shower curtain typically looks like a functional product. While many curtains may have a design imprinted thereon, sometimes the design being quite elaborate, the rod and the hooks that slide along the rod look quite industrial. Some users attempt to spruce up this aspect of the shower curtain by using rods and hooks that either come in fancy colors or are made from exotic metals, such as brass or polished nickel, however, the rod and the hooks visually remain what they are, functional.

Some have proposed devices that are used to conceal the rod and the hooks thereon, however, such devices tend to suffer from certain drawbacks. Many such prior art devices are unusually complex in design and construction making such devices unnecessarily expensive to manufacture and purchase, as well as difficult to install and use. Other devices appear for what they are, a concealment device that only looks marginally better than the rod and hooks that are being concealed.

Others eliminate the shower curtain altogether by installing a door on the shower enclosure. However, such a solution finds disfavor with many as it can be a costly retrofit and many home owners dislike the look of a sliding door over a bath tub, even less so than the look of a rod with hooks and a curtain hanging therefrom. Additionally, many folks do not like their bath tubs partially enclosed by the sliding door panels whenever a bath is taken.

Accordingly, there exists a need in the art for a device that allows a person to maintain a shower curtain barrier system for a shower enclosure while allowing the rod and curtain hooks to be concealed from view of a bathroom user. Such a device must be of relatively simple design and construction so that it is relatively inexpensive to manufacture and thus purchase by the shower curtain owning public. Such a device must be relatively easy to install and use once so installed.

Ideally, such a device must not appear to simply be a concealment barrier for another product.

SUMMARY OF THE INVENTION

The shelf for overlying a shower barrier of the present invention addresses the aforementioned needs in the art by providing a device that conceals the shower curtain rod and the hooks that slide therealong. The shelf for overlying a shower barrier is a relatively simple and straightforward device that is relatively inexpensive to manufacture thereby making the device readily affordable to a large segment of the buying public. The shelf for overlying a shower barrier is relatively simple to install, typically requiring little more effort than is necessary to install the curtain rod itself, and is easy to use and maintain once so installed. The shelf for overlying a shower barrier is aesthetically pleasing without having the appearance of simply being a concealment device for the rod and hooks thereon.

The shelf for overlying a shower barrier of the present invention is comprised of a first shelf unit that has a first flat upper surface, a downwardly depending first front surface, and a first end. A second shelf unit has a second flat upper surface, a downwardly depending second front surface, and a second end. A connector shelf unit has a third flat upper surface, a downwardly depending third front surface such that the first shelf unit is capable of sliding within a first end of the connector shelf unit and the second shelf unit is capable of sliding within a second end of the connector shelf. The first end of the first shelf unit is positioned in abutting relationship with a first wall of a shower enclosure and the second end of the second shelf unit is positioned in abutting relationship with a second wall of the shower enclosure such that holding means hold the first shelf unit in fixed relationship with the connector shelf unit and hold the second shelf unit in fixed relationship with the connector shelf unit. The holding means is located underneath the first upper surface, the second upper surface, and the third upper surface and behind the first front surface, the second front surface, and the third front surface so as to be concealed from view from a user of the bathroom wherein the present invention is located. The holding means may comprises a first telescoping rod that is attached to the first shelf unit and to the connector unit with the first telescoping rod having at least one first opening. A first set screw passes through the at least one first opening for preventing the first telescoping rod from moving7. A second telescoping rod is attached to the second shelf unit and to the connector unit with the second telescoping rod having at least one second opening. A second set screw passes through the at least one second opening for preventing the second telescoping rod from moving. Alternately, the holding means may comprise a first plate that is attached to the first shelf unit and a second plate that is attached to the second shelf unit. A compression spring is positioned so as to abut the first plate and the second plate. Still alternately, the holding means may comprise a first bracket that is attached to the first wall and to the first shelf unit and a second bracket that is attached to the second wall and to the second shelf unit. The first bracket is attached to the first wall by passing a first screw through the first bracket and into the first wall, the first bracket is attached to the first shelf unit by passing a second screw through the first shelf unit and the first bracket. The second bracket is attached to the second wall by passing a third screw through the second bracket and into the second wall, and the second bracket is attached to the second shelf unit by passing a fourth screw through the second shelf unit and the second bracket. Still alternately, the holding means may comprise a first screw that passes through a first screw boss located on the first end of the first shelf unit, the first screw passing into the first wall and a second screw that passes through a second screw boss located on the second end of the second shelf unit, the second screw passing into the second wall. A first cap may be attached to the first end of the first shelf unit while a second cap may attached to the second end of the second shelf unit. The shower barrier may comprise a curtain rod or a top of a shower door.

Alternately, the shelf for overlying a shower barrier of the present invention is comprised of a shelf unit that has a flat upper surface, a downwardly depending front surface, a first end that is attached to the first wall and a second end that us attached to the second wall. Either a first portion of caulk is located at the joiner of the first end and the first wall and a second portion of caulk is located at the joiner of the second end and the second wall or a first clip is attached to the shelf unit at the joiner of the first end and the first wall and a second clip is attached to the shelf unit at the joiner of the second end and the second wall.

BRIEF DESCRIPTION OF THE DRAWINGS

Similar reference numerals refer to similar parts throughout the several views of the drawings.

DESCRIPTION OF THE PREFERRED EMBODIMENT

Figure 1:
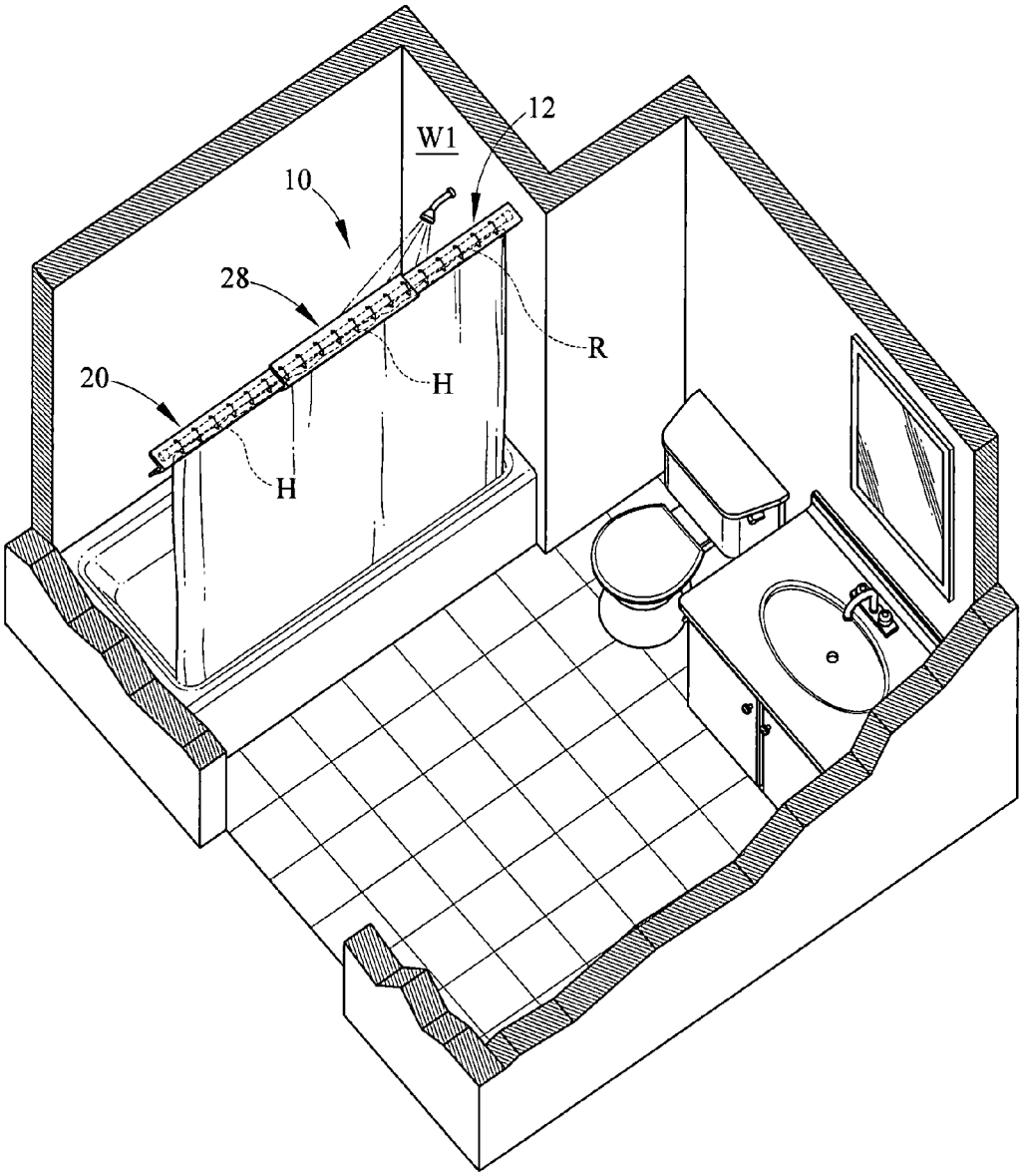
FIG. 1 is a perspective view (top) of the shelf for overlying a shower barrier of the present invention overlying a shower curtain rod.
Figure 2:
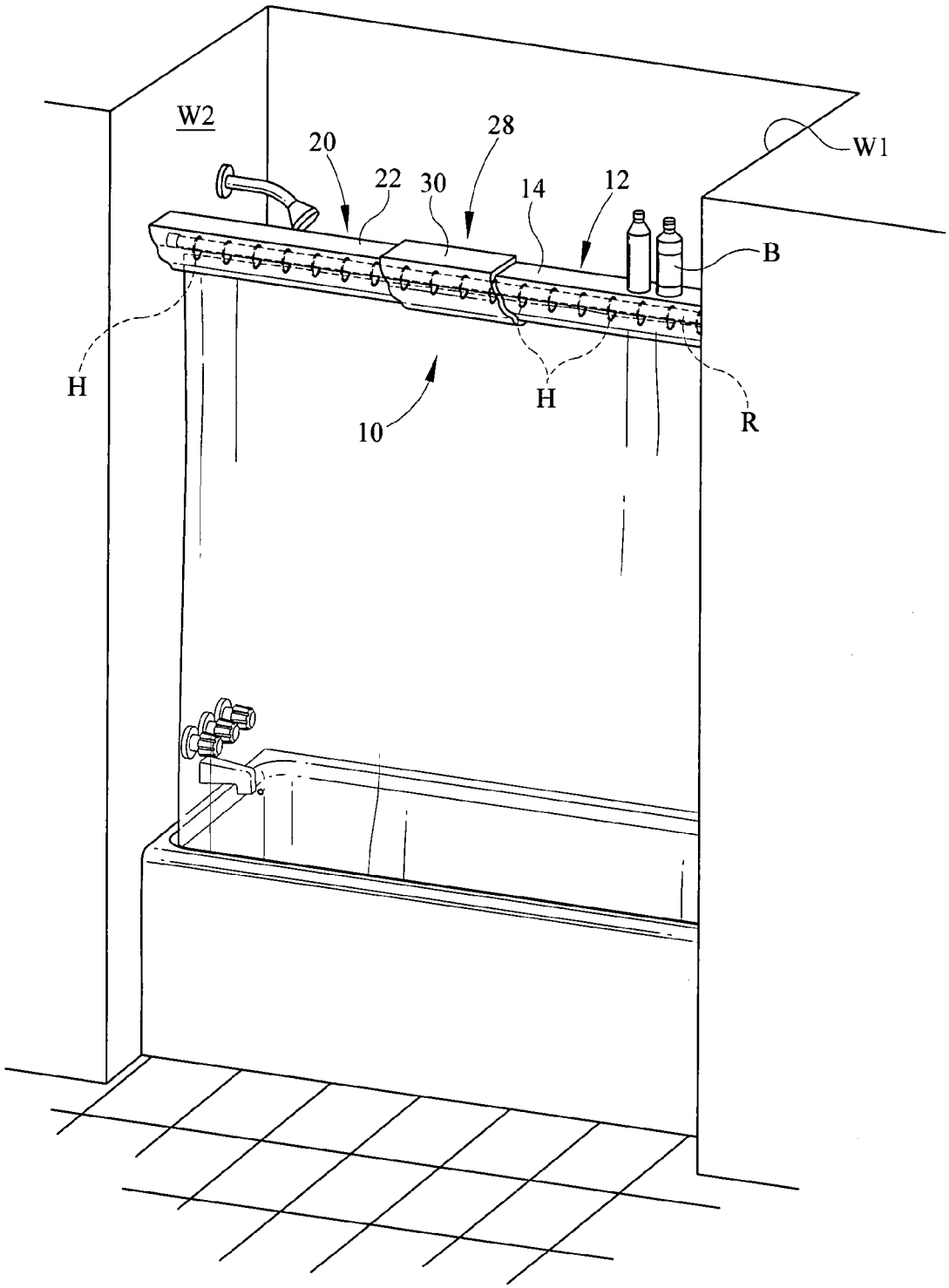
FIG. 2 is a perspective view (front) of the shelf for overlying a shower barrier overlying a shower curtain rod.
Figure 3:
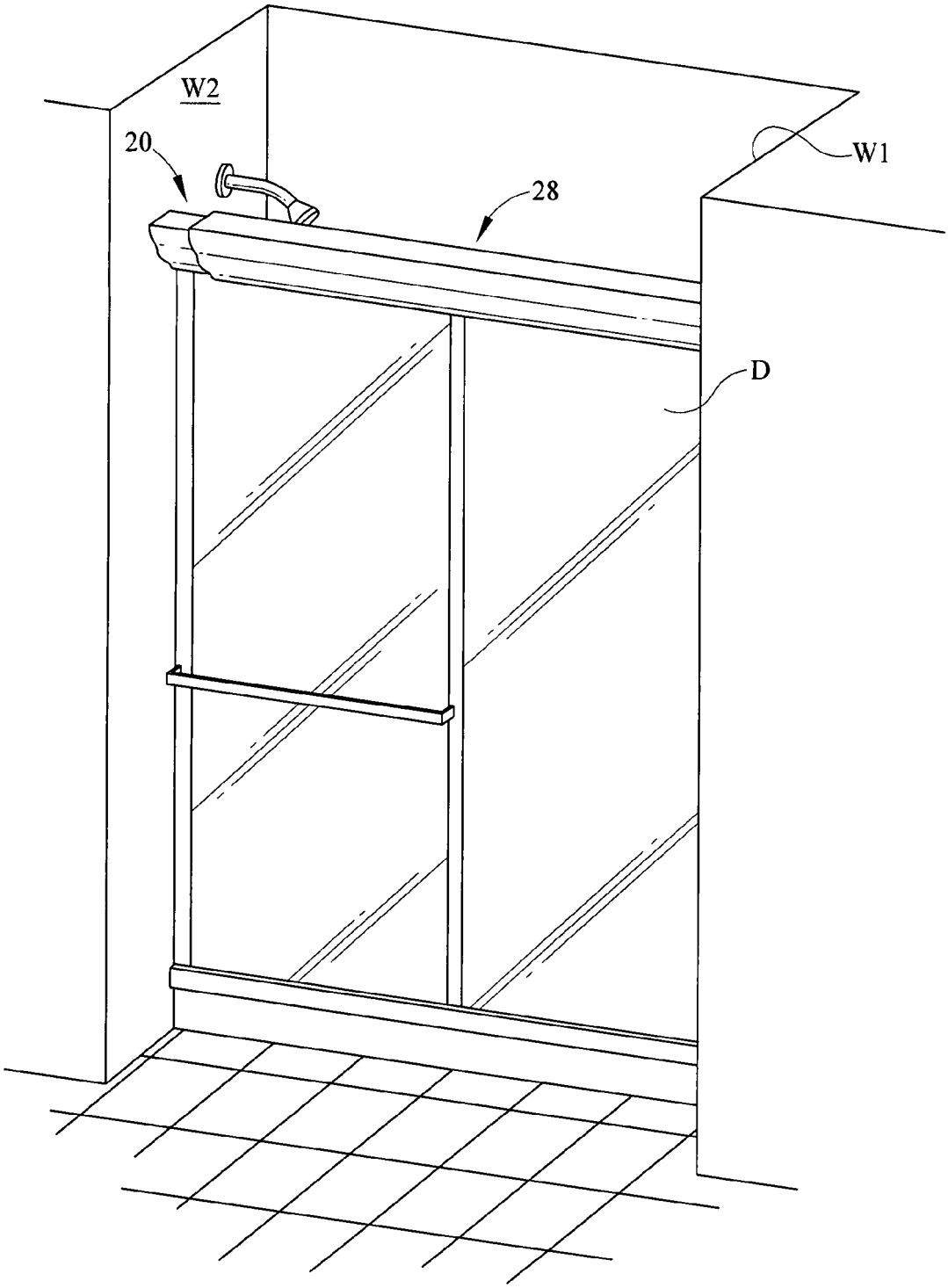
FIG. 3 is a perspective view (front) of the shelf for overlying a shower barrier overlying a shower door.

Referring now to the drawings, it is seen that the shelf for overlying a shower barrier of the present invention, generally denoted by reference numeral 10, is comprised of a first shelf unit 12 that has a relatively flat first upper surface 14 and a generally downwardly depending first front surface 16. The end 18 of the first shelf unit 12 is relatively flat. A substantially similar second shelf unit 20 also has a relatively flat second upper surface 22 and a generally downwardly depending second front surface 24. The end 26 of the second shelf unit 20 is relatively flat. A connector shelf 28 has a relatively flat third upper surface 30 and a generally downwardly depending third front surface 32. The connector shelf unit 28 is similar in appearance to the appearance of the first shelf unit 12 and the second shelf unit 20 although it is somewhat larger to permit a portion of the first shelf unit 12 to slide within the connector shelf unit 28 and a portion of the second shelf unit 20 to also slide within the connector shelf unit 28. The sliding of the first shelf unit 12 and the second shelf unit 20 within the connector shelf unit 28 allows the overall shelf for overlying a shower barrier 10 to be telescoping in order to accommodate shower enclosures having different widths.

The relatively flat upper surfaces 14, 22, and 30 of the respective shelf units 12, 20, and 28 are flat in order to comfortably hold various items, such as hair care bottles B, thereon. However, the downwardly depending front surfaces 16, 24, and 32 of the respective shelf units 12, 20, and 32 can have any desired shape and can have any design or color scheme thereon, only limited by the imagination of the designer, these front surfaces 16, 24, and 32, providing a large portion of the aesthetic quality of shelf for overlying a shower barrier 10.

Figure 8:
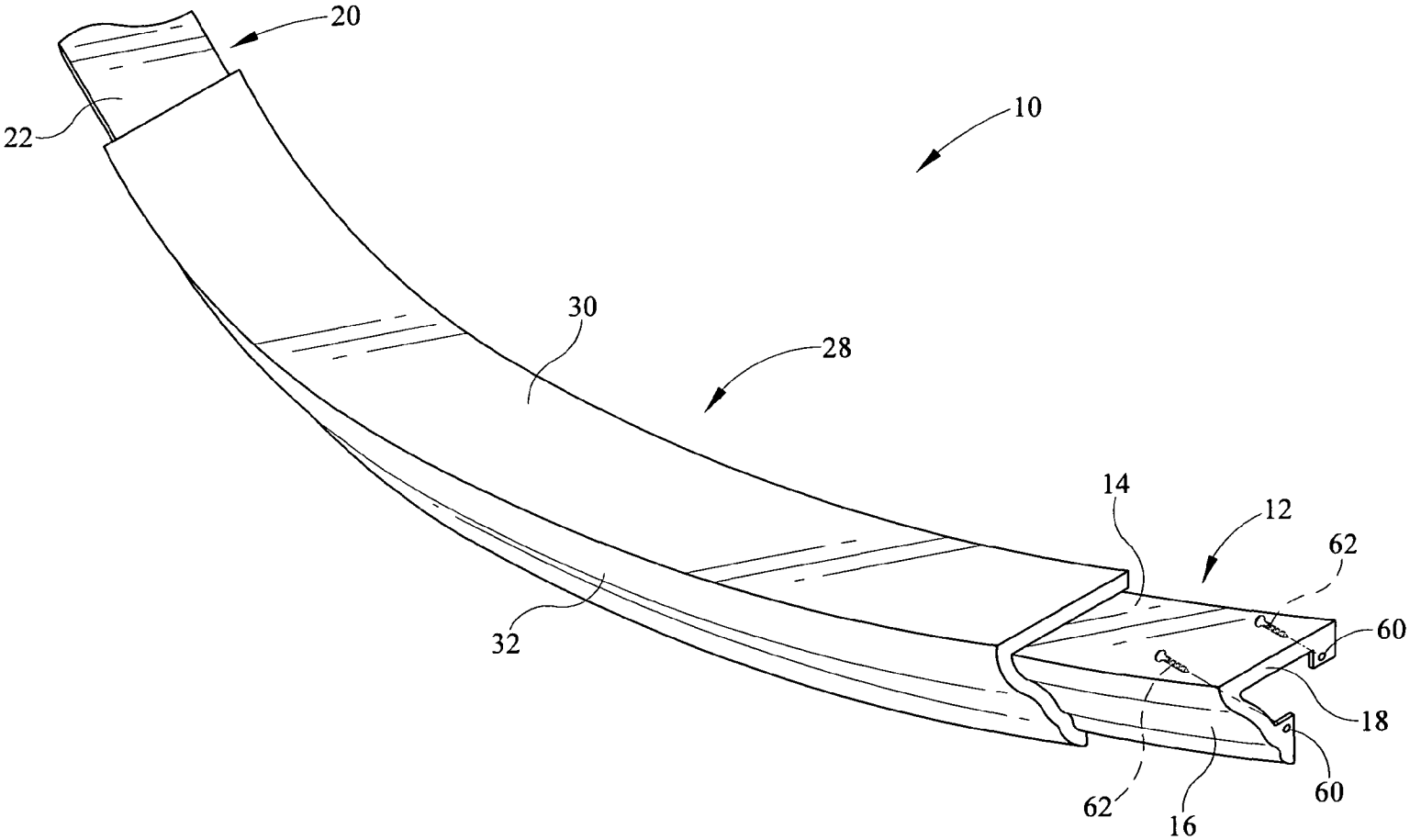
FIG. 8 is a perspective view of the shelf for overlying a shower barrier of the present invention for use in overlying a curved curtain rod.

The first shelf unit 12, the second shelf unit 20, and the connector shelf unit 28 can be made from any appropriate sturdy material such as plastic, wood that is appropriately sealed against the harsh moisture environment within which the shelf for overlying a shower barrier 10 operates, etc. The first shelf unit 12, the second shelf unit 20, and the connector shelf unit 28 can form a single straight unit for the typical shower curtain rod R or shower door D, or can be curved, as seen in FIG. 8, to overlie curved shower curtain rods that are finding favor with many homeowners.

Figure 4:
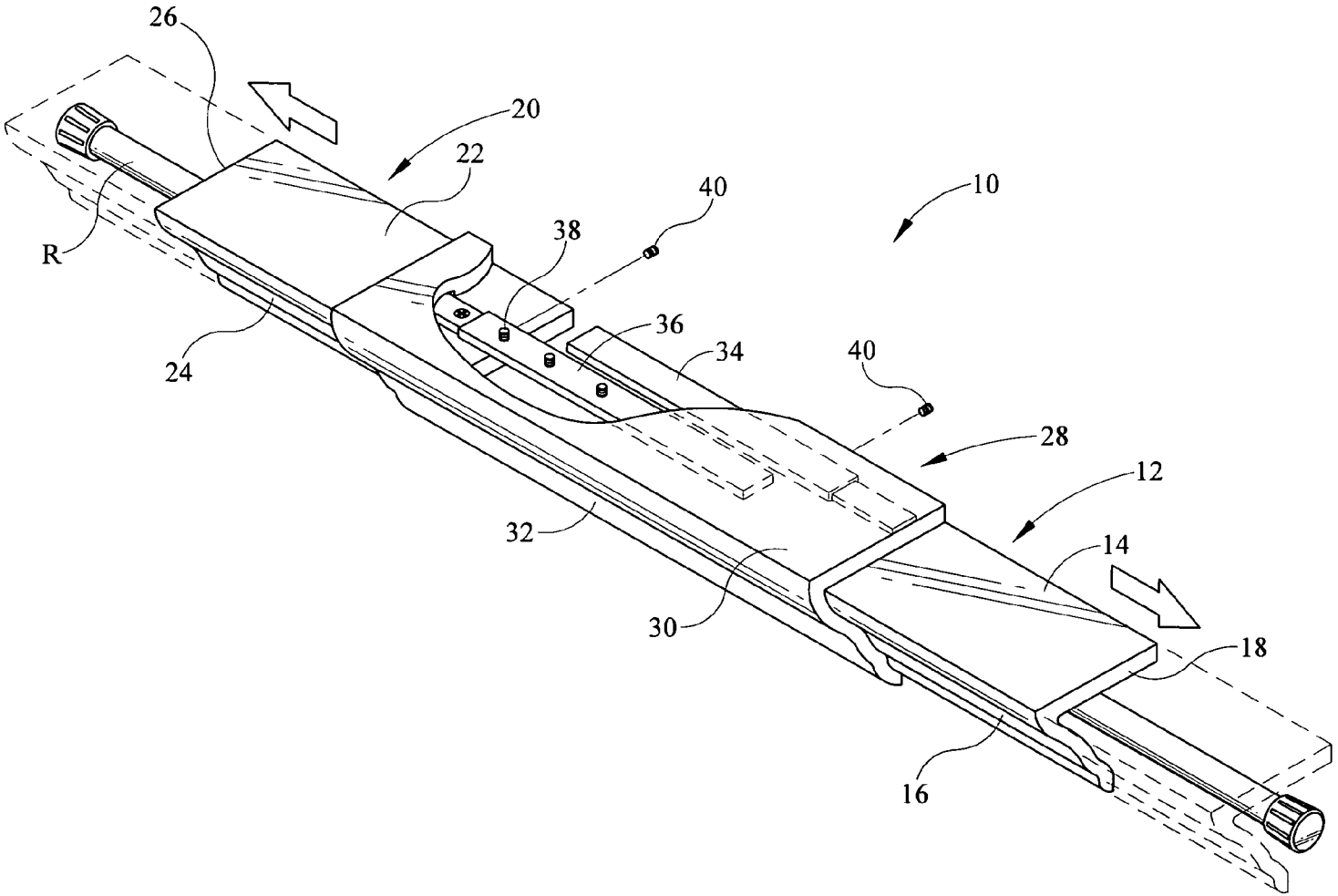
FIG. 4 is a perspective view, partially cutaway, of the shelf for overlying a shower barrier.

The shelf for overlying a shower barrier 10 is positioned within a shower enclosure in overlying relationship with either a shower curtain rod R and its hooks H that slide therealong or over the top of a shower door D. The first shelf unit 12 is positioned so as to abut a first side wall W1 of the shower enclosure while the second shelf unit 20 is positioned to abut the opposing second side wall W2 of the shower enclosure. Referring to FIG. 4, the first shelf unit 12 and the second shelf unit 20 are held in abutting relationship with their respective side walls W1 and W2 by attaching a first telescoping bar 34 to the first shelf unit 12 and connector shelf unit 28 and attaching a second telescoping bar 36 to the second shelf unit 20 and the connector shelf unit 28, each bar 34 and 36 having a series of openings 38 thereon. Whenever the first shelf unit 12 is in the desired position, a set screw 40 is passed through an opening 38 on the first telescoping bar 34 in order to hold this first bar 34, and thus the first shelf unit 12 with respect to the connector shelf unit 28, firmly in place. Similarly, whenever the second shelf unit 20 is in the desired position, a set screw 40 is passed through an opening 38 on the second telescoping bar 36 in order to hold this second bar 36, and thus the second shelf unit 20 with respect to the connector shelf unit 28, firmly in place. The shelf for overlying a shower barrier 10 is now installed and conceals the curtain rod R and its hooks H or the top of the shower door D. The upper surfaces 14, 22, and 30 of the respective shelf units 12, 20, and 28 can be used for storage as desired while the front surfaces 16, 24, and 32 of the respective shelf units 12, 20, and 28 act as an overall aesthetic concealment member.

Figure 5:
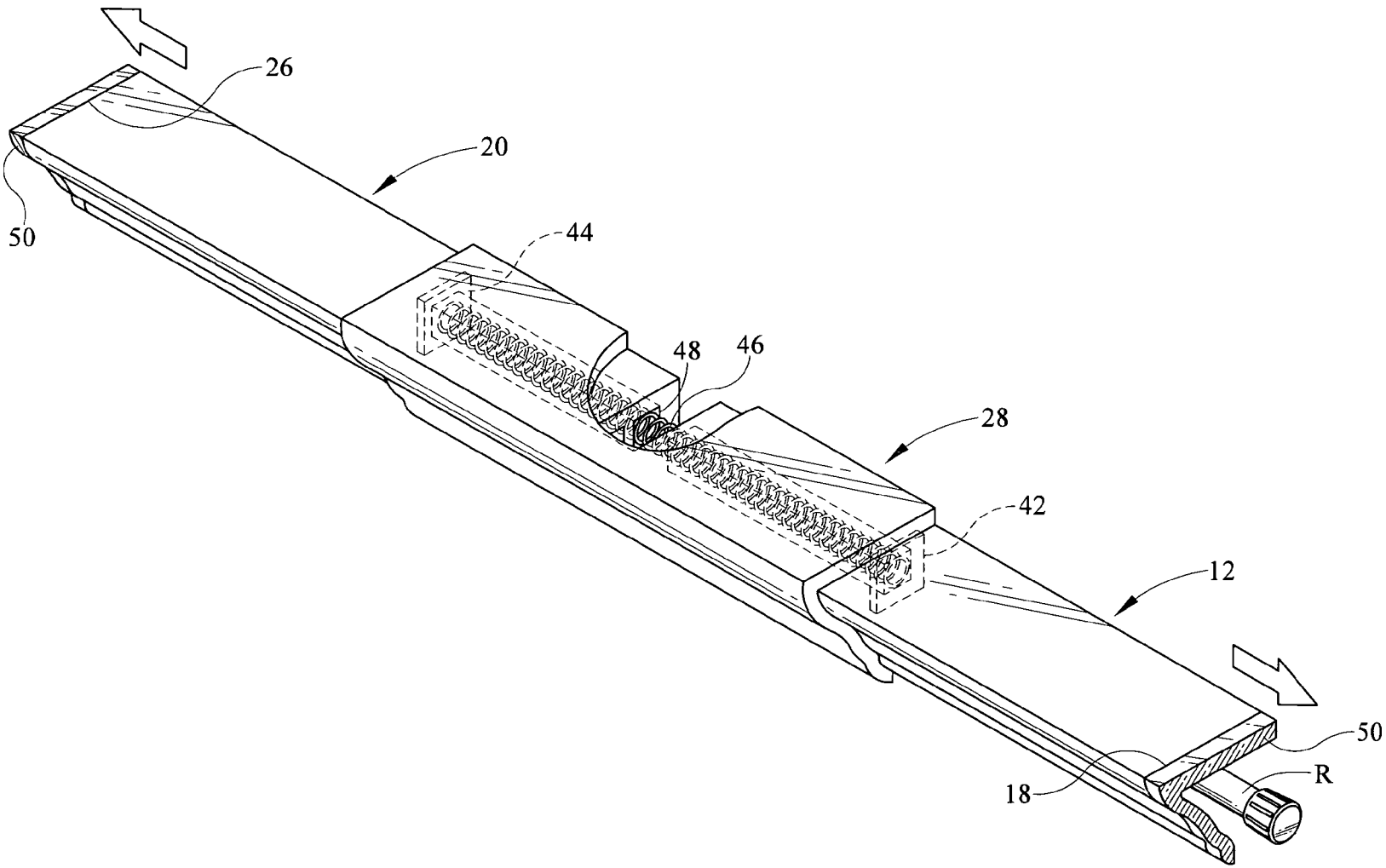
FIG. 5 is a perspective view, partially cutaway, of an alternate embodiment of the shelf for overlying a shower barrier of the present invention.

Referring to FIG. 5, the shelf for overlying a shower barrier 10 uses an alternate means for holding the device 10 against the side walls W1 and W2. As seen, a first plate 42 is attached to the first shelf unit 12 while a second plate 44 is attached to the second shelf unit 20. A compression spring 46 is positioned in abutting relationship with the first plate 42 and the second plate 44. When the shelf for overlying a shower barrier 10 is positioned between the side walls W1 and W2, the compression spring 46 acts on the two plates 42 and 44 in order to hold the two shelf units 12 and 20 in abutting relationship with their respective side walls W1 and W2. The spring 46 is disposed within an appropriate channel 48 located within the first shelf unit 12 and the second shelf unit 20 helping keep the spring 46 in place As also seen in this figure, a protective cap 50 can be placed on the end 18 of the first shelf unit 12, and the second shelf unit 20, the protective cap 50 being made from an appropriate material such as rubber or neoprene.

Figure 6:
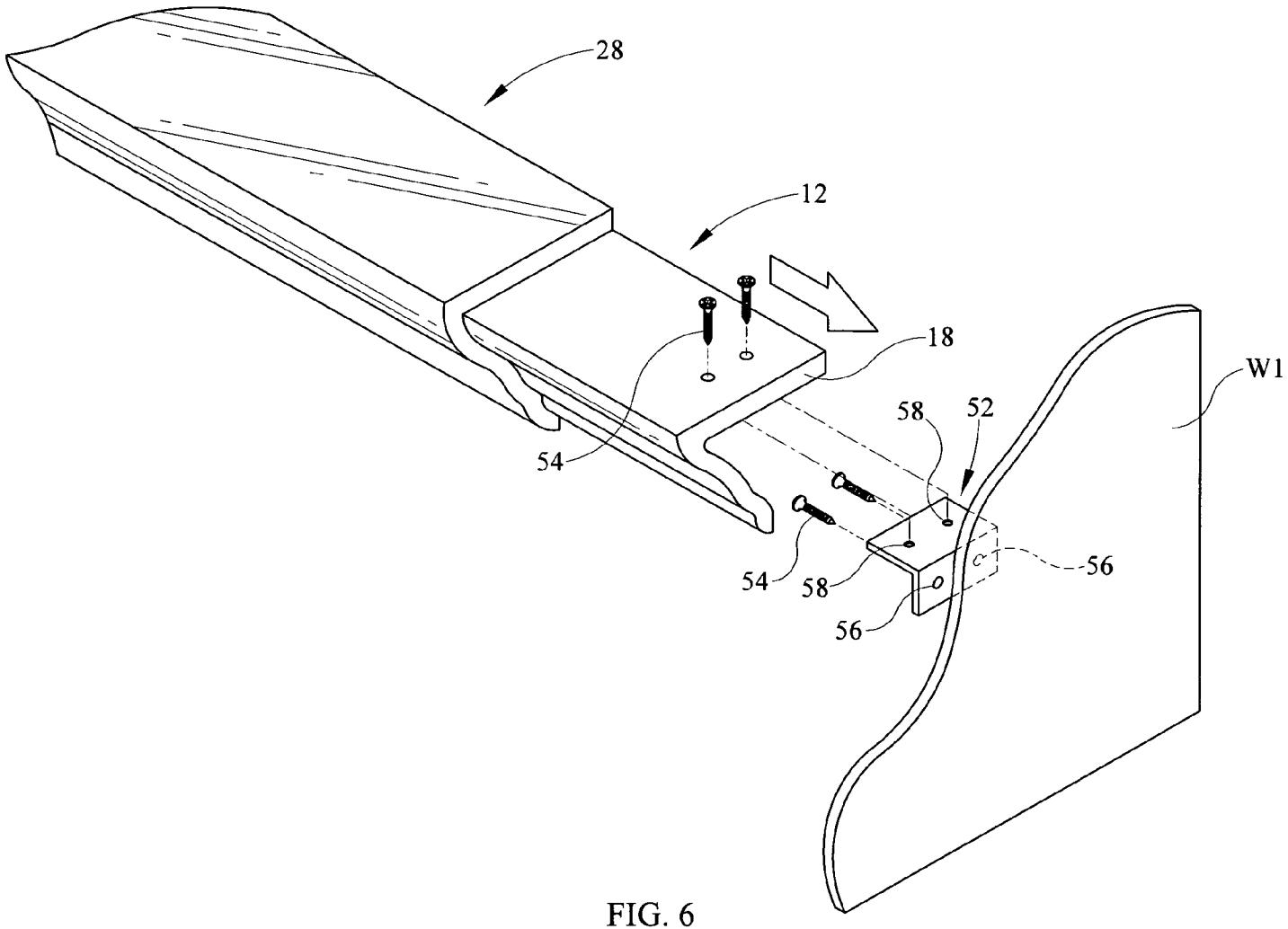
FIG. 6 is a perspective view of a second alternate embodiment of the shelf for overlying a shower barrier of the present invention.

As seen in FIG. 6, another alternate means for attaching the shelf for overlying a shower barrier 10 to the side walls W1 and W2 calls for an angle bracket 52, each bracket 52 being attached to one of the walls W1 and W2 in any appropriate fashion such as by passing screws 54 through first openings 56 on the bracket 52 with the screws 54 passing into the walls W1 and W2. The bracket 52 is also attached to each of the first shelf unit 12 and the second shelf unit 20 in appropriate fashion such as by passing screws 54 through the upper surfaces 14 and 22 of each respective shelf 12 and 20 and through second openings 58 on the bracket 52.

Figure 7:
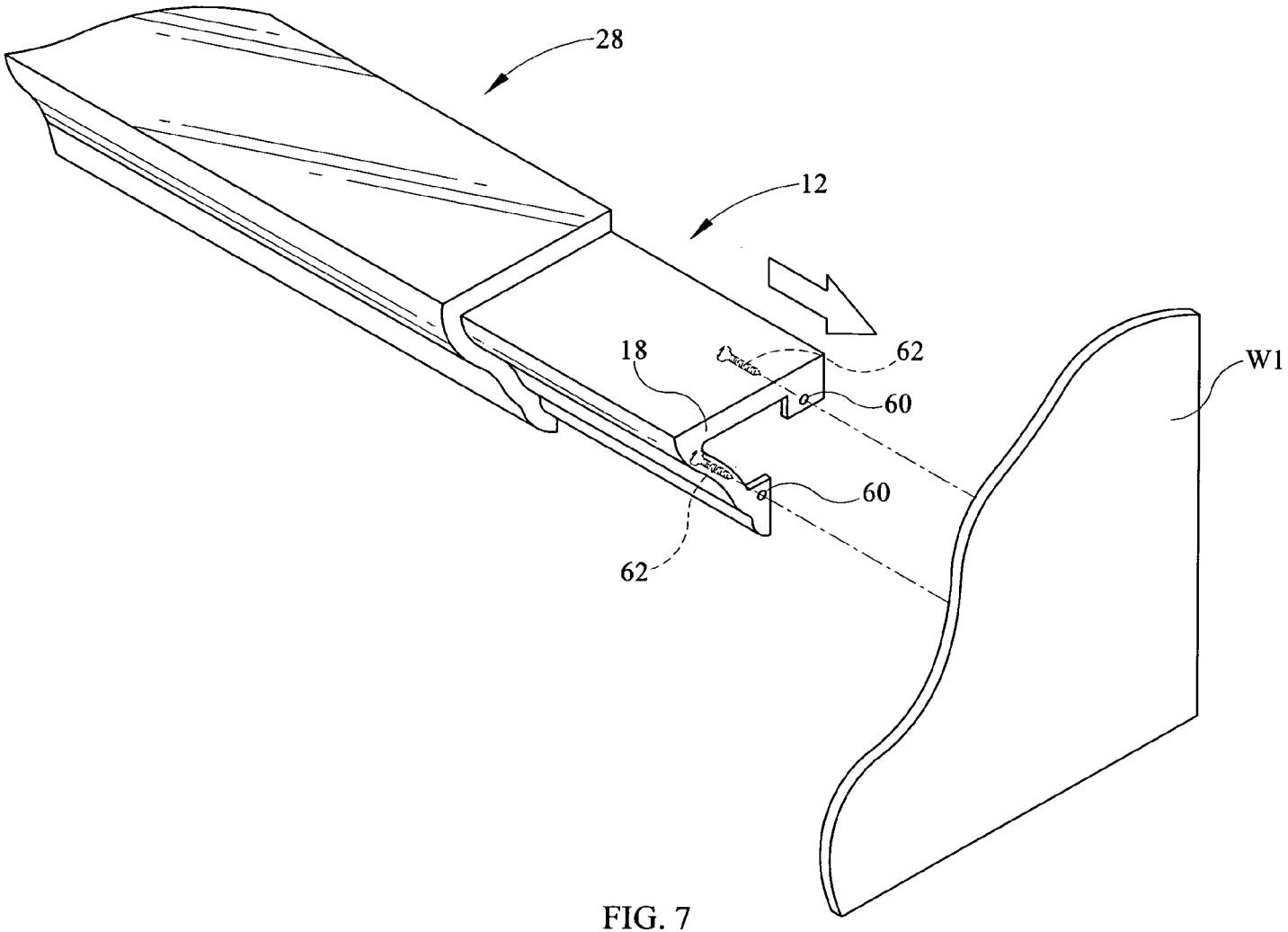
FIG. 7 is a perspective view of a third alternate embodiment of the shelf for overlying a shower barrier of the present invention.

As seen in FIG. 7, yet another alternate means for attaching the shelf for overlying a shower barrier 10 to the side walls W1 and W2 calls for screw bosses 60 to be located on the end 18 of the first shelf unit 12 and the end 26 of the second shelf unit 20 and passing screws 62 through the screw bosses 60 and into the walls W1 and W2.

Other attachment means can be used to attach the shelf for overlying a shower barrier 10 to the side walls W1 and W2 in keeping with the scope and spirit of the present invention.

While the invention has been particularly shown and described with reference to embodiments thereof, it will be appreciated by those skilled in the art that various changes in form and detail may be made without departing from the spirit and scope of the invention.

We claim:

1. A concealment unit for overlying a shower barrier, that extends between a first wall and a second wall of a shower enclosure, the concealment unit comprising:

a first shelf unit having a first flat upper surface and an opposing first lower surface, a downwardly depending first front surface having a first outer face and an opposing first inner face such that a first channel is formed by the first lower surface and the first inner face, the first lower surface defining a first channel top and such that an opposing first channel bottom is open, and a first end;

a second shelf unit having a second flat upper surface and an opposing second lower surface, a downwardly depending second front surface having a second outer face and an opposing second inner face such that a second channel is formed by the second lower surface and the second inner face the second lower surface defining a second channel top and such that an opposing second channel bottom is open, and a second end;

a connector shelf unit having a third flat upper surface and an opposing third lower surface, a downwardly depending third front surface having a third outer face and an opposing third inner face such that a third channel is formed by the third lower surface and the third inner face the third lower surface defining a third channel top and such that an opposing third channel bottom is open such that the first shelf unit is capable of sliding within a first end of the connector shelf unit within the third channel and the second shelf unit is capable of sliding within a second end of the connector shelf within the third channel; and wherein the first end of the first shelf unit is adapted to be positioned in abutting relationship with the first wall and the second end of the second shelf unit is adapted to be positioned in abutting relationship with the second wall and wherein holding means hold the first shelf unit in fixed relationship with the connector shelf unit, the holding means comprising a first plate attached to the first shelf unit within the first channel, the first plate projecting downward from the first lower surface of the first shelf unit; a second plate attached to the second shelf unit within the second channel, the second plate projecting downward from the second lower surface of the second shelf unit; and a compression spring positioned so as to have a first spring end abut the first plate and a second spring end abut the second plate and hold the second shelf unit in fixed relationship with the connector shelf unit.

2. The concealment unit as in claim 1 wherein the holding means is located underneath the first upper surface, the second upper surface, and the third upper surface and behind the first front surface, the second front surface, and the third front surface and being disposed within the first open channel, the second open channel and the third open channel.

3. The concealment unit as in claim 1 further comprising:

a first cap attached to the first end of the first shelf unit; and a second cap attached to the second end of the second shelf unit.

4. The concealment unit as in claim 1 in combination with the shower barrier.

5. The concealment unit as in claim 4 wherein the shower barrier comprises a curtain rod.

6. The concealment unit as in claim 4 wherein the shower barrier comprises a top of a shower door.

* * * * *